US011073270B2

(12) United States Patent
Ishii

(10) Patent No.: US 11,073,270 B2
(45) Date of Patent: Jul. 27, 2021

(54) VEHICULAR HEADLIGHT

(71) Applicant: Ichikoh Industries, Ltd., Isehara (JP)

(72) Inventor: Satoru Ishii, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 16/488,672

(22) PCT Filed: Feb. 26, 2018

(86) PCT No.: PCT/JP2018/006945
§ 371 (c)(1),
(2) Date: Aug. 26, 2019

(87) PCT Pub. No.: WO2018/155684
PCT Pub. Date: Aug. 30, 2018

(65) Prior Publication Data

US 2019/0376679 A1 Dec. 12, 2019

(30) Foreign Application Priority Data

Feb. 27, 2017 (JP) ..... JP2017-034913

(51) Int. Cl.
*F21V 29/67* (2015.01)
*F21V 29/83* (2015.01)
(Continued)

(52) U.S. Cl.
CPC ..... *F21V 29/677* (2015.01); *F21S 41/147* (2018.01); *F21S 45/43* (2018.01); *F21V 29/83* (2015.01)

(58) Field of Classification Search
CPC ..... F21V 29/67; F21V 29/83; F21S 41/147; F21S 45/43
(Continued)

(56) References Cited

U.S. PATENT DOCUMENTS

2009/0262550 A1 10/2009 Inoue
2011/0051453 A1 3/2011 Nagasawa et al.
(Continued)

FOREIGN PATENT DOCUMENTS

JP 2009-266436 A 11/2009
JP 2010-262903 A 11/2010
(Continued)

OTHER PUBLICATIONS

Supplementary European Search Report dated Nov. 18, 2020 in corresponding European Patent Application No. 18757708.5, 1 page.
(Continued)

*Primary Examiner* — Andrew J Coughlin
*Assistant Examiner* — Jessica M Apenteng
(74) *Attorney, Agent, or Firm* — Oblon, McClelland, Maier & Neustadt, L.L.P.

(57) ABSTRACT

A vehicular headlight which, by using a fan, can efficiently cool a light source through a heat sink and also efficiently cool a light source drive circuit. The vehicular headlight includes a lamp housing, a lamp lens, a lamp unit, a fan, and a light source drive circuit. The lamp unit includes a light source, a heat sink, and a light control member. An outlet side of the fan faces the heat sink, and an intake side of the fan faces the light source drive circuit. The vehicular headlight can efficiently cool the light source through the heat sink and also efficiently cool the light source drive circuit.

7 Claims, 3 Drawing Sheets

(51) Int. Cl.
*F21S 41/147* (2018.01)
*F21S 45/43* (2018.01)

(58) Field of Classification Search
USPC ..... 362/507
See application file for complete search history.

(56) References Cited

U.S. PATENT DOCUMENTS

| | | | | |
|---|---|---|---|---|
| 2012/0038272 | A1* | 2/2012 | De Castro | F21S 41/143 315/35 |
| 2015/0176795 | A1* | 6/2015 | Kikuchi | F21S 45/43 362/523 |

FOREIGN PATENT DOCUMENTS

| | | | |
|---|---|---|---|
| JP | 2011-258411 | A | 12/2011 |
| JP | 2012-174539 | A | 9/2012 |
| JP | 2014-120344 | A | 6/2014 |
| JP | 2016-31777 | A | 3/2016 |
| JP | 2016-58547 | A | 4/2016 |

OTHER PUBLICATIONS

International Search Report dated Apr. 24, 2018 in PCT/JP2018/006945 filed Feb. 26, 2018.

* cited by examiner

VEHICULAR HEADLIGHT

TECHNICAL FIELD

The present invention relates to a vehicular headlight provided with a lamp unit, a fan, and a light source drive circuit.

BACKGROUND ART

The vehicular headlight disclosed in PTL 1 is one example of vehicular headlights provided with a lamp unit, a fan, and a light source drive circuit. The vehicular headlight of PTL 1 includes a light source, a heat transfer portion, a fan, and a control unit for the light source in a lamp chamber formed by a lamp body and a front cover. The fan is mounted on a maintenance cover detachably mounted on the lamp body, the control unit is mounted on the lamp body, and the light source and the fan face each other through the heat transfer portion (see FIGS. 2, 3, and 9 of PTL 1). The vehicular headlight of PTL 1 forcibly sends air to the heat transfer portion using the fan, whereby the heat generated by the light source is efficiently cooled through the heat transfer portion.

CITATION LIST

Patent Literature

PTL 1: Japanese Patent Application Publication No. 2010-262903

SUMMARY OF THE INVENTION

Problems to be Solved by the Invention

However, in the vehicular headlight of PTL 1, since the fan is mounted on the maintenance cover detachably mounted on the lamp body and the control unit is mounted on the lamp body, it is difficult to efficiently cool the control unit by using the fan.

The problem to be solved by the present invention is to provide a vehicular headlight which can efficiently cool a light source through a heat sink by using a fan, and can also efficiently cool a light source drive circuit by using the fan.

Means for Solving the Problem

A vehicular headlight according to the present invention includes a lamp housing and a lamp lens that form a lamp chamber, a lamp unit disposed in the lamp chamber and attached to the lamp housing via an optical axis adjustment mechanism, and a fan and a light source drive circuit disposed in the lamp chamber and attached to the lamp housing separately from the lamp unit, wherein the lamp unit includes a light source driven by the light source drive circuit, a heat sink, and a light control member arranged to control light from the light source, and an outlet side of the fan faces the heat sink, and an intake side of the fan faces the light source drive circuit.

In the vehicular headlight according to the present invention, it is preferable that the heat sink includes a mounting portion to which the light source is attached, and a plurality of heat radiating portions having a columnar shape, provided on an opposite side of the mounting portion to the light source, and facing the outlet side of the fan.

In the vehicular headlight according to the present invention, it is preferable that the light source drive circuit includes a casing attached to the lamp housing, a substrate on which an electronic component is mounted, and a heat conductive medium with which a portion of the casing, the portion being on the intake side of the fan, and the substrate are closely fixed to each other.

In the vehicular headlight according to the present invention, it is preferable that the light control member faces the outlet side of the fan through the heat sink.

Effect of the Invention

The vehicular headlight according to the present invention can efficiently cool a light source through a heat sink by using a fan, and can also efficiently cool a light source drive circuit by using the fan.

MODE FOR CARRYING OUT THE INVENTION

Figure 1:
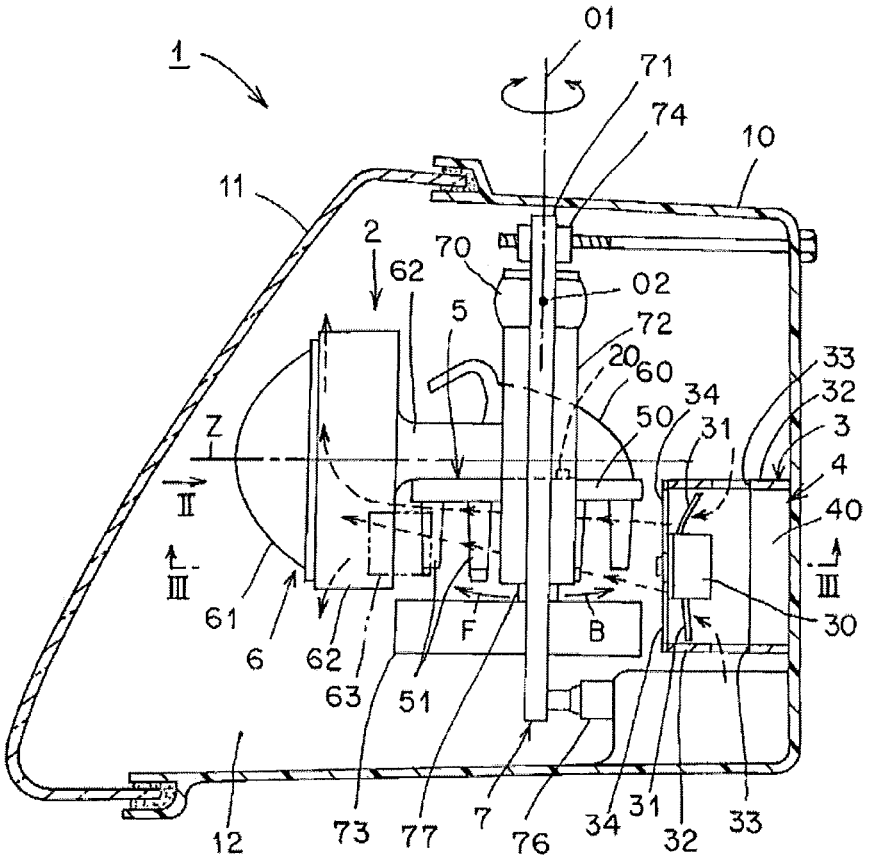
FIG. 1 is a schematic longitudinal sectional view (schematic vertical sectional view) showing an embodiment of a vehicular headlight according to the present invention.
Figure 2:
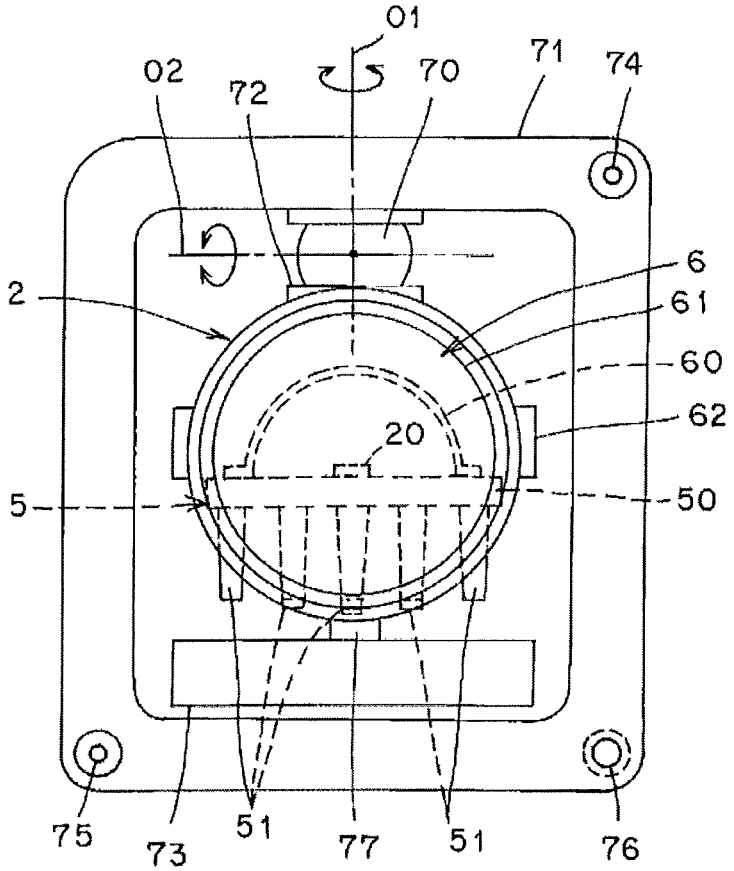
FIG. 2 is a schematic front view (a view from the arrow II in FIG. 1) showing a lamp unit.

Hereinafter, an embodiment (example) of a vehicular headlight according to the present invention will be described in detail with reference to the drawings. In the description, the front, rear, up, down, right, and left denote the front, rear, up, down, right, and left in a state where the vehicular headlight according to the invention is mounted on a vehicle. The drawings are schematic views in which main components are illustrated while other components are not illustrated. The dashed arrows in FIGS. 1, 3, and 4 indicate the air or the flow of air.

(Description of the Configuration of the Embodiment)

Hereinafter, the configuration of a vehicular headlight according to the present embodiment will be described. In the drawings, reference numeral 1 denotes a vehicular headlight according to the present embodiment.

(Description of Vehicular Headlight 1)

The vehicular headlights 1 are mounted on the right, and left sides of the front portion of a vehicle (not shown). Each vehicular headlight 1 is a headlamp in this example. Each vehicular headlight 1 includes a lamp housing 10, a lamp lens 11, a lamp unit 2, a fan 3, and a light source drive circuit 4 as shown in FIG. 1.

The lamp housing 10 and the lamp lens (e.g., a transparent outer lens) 11 form a lamp chamber 12. The lamp unit 2, the fan 3, and the light source drive circuit 4 are disposed in the lamp chamber 12. While components other than the lamp unit 2 are not shown in the lamp chamber 12 in the drawing, an ADB irradiation lamp unit, a fog lamp, a cornering lamp, a clearance lamp, a turn signal lamp, an overhead sign lamp, a daytime running lamp, or the like may be disposed therein.

(Description of Lamp Unit 2)

The lamp unit 2 is a projector type lamp unit in this example. The lamp unit 2 includes a light source 20, a heat sink 5, and a light control member 6. The lamp unit 2 emits at least one of an unillustrated low beam light distribution pattern (passing light distribution pattern) and an unillustrated high beam light distribution pattern (driving light distribution pattern) along an optical axis Z to transmit the light distribution pattern(s) through the lamp lens 11, and irradiates an area in front of the vehicle with the light distribution pattern(s). The lamp unit 2 is attached to the lamp housing 10 via an optical axis adjustment mechanism (an aiming mechanism and a swivel mechanism) 7.

(Description of Light Source 20)

The light source 20 is a semiconductor type light source in this example, and a self-emitting semiconductor type light source such as an LED, an OEL, or an OLED (organic EL) is used. The light source 20 is driven by the operation of the light source drive circuit 4; that is, the light source 20 emits light. The light source 20 generates heat when emitting light.

(Description of Heat Sink 5)

The heat sink 5 includes a mounting portion 50 and a plurality of heat radiating portions 51. The mounting portion 50 has a plate shape and is disposed parallel or approximately parallel to the optical axis Z of the lamp unit 2, that is, is disposed horizontally or approximately horizontally, in this example. The light source 20 is mounted at the center of a flat surface (upper surface) of the mounting portion 50. The plurality of heat radiating portions 51 is provided integrally on a bottom surface (lower surface) of the mounting portion 50, the bottom surface being opposite to the light source 20, so as to be vertical or approximately vertical to the optical axis Z of the lamp unit 2. That is, the heat radiating portions 51 project downward from the mounting portion 50. The plurality of heat radiating portions 51 faces an outlet on an outlet side of the fan 3.

In this example, the heat radiating portions 51, each of which has an approximately cylindrical shape, are arranged in a staggered manner (arranged alternately). With this configuration, the plurality of heat radiating portions 51 has no directivity in the direction of the air flow (the blown air direction) from the fan 3 used for heat radiation of the light source 20. Concerning the vertical lengths of the heat radiating portions 51, the heat radiating portion 51 at the center of the mounting portion 50 at which the light source 20 is attached is the longest while the other heat radiating portions 51 get shorter as they get closer to the periphery of the mounting portion 50. In addition, all the heat radiating portions 51 have a same or almost same horizontal cross-sectional area (diameter). Further, the heat radiating portions 51 are slightly larger in horizontal cross-sectional area at their upper end portions than at their lower end portions. A guide member to guide the air forcibly sent from the fan 3 to pass through the space among the plurality of heat radiating portions 51 may be provided, which is not shown in the drawings.

(Description of Light Control Member 6)

In this example, the light control member 6 includes a reflector 60 and a projection lens 61. The reflector 60 is attached to a flat surface of the mounting portion 50 of the heat sink 5. A reflecting surface formed of a free-form surface based on an ellipsoid of revolution (elliptic) is provided on the inner surface of the reflector 60. The reflecting surface has two focal points and an optical axis. The light source 20 is disposed at or near one of the focal points.

The projection lens 61 is attached to the mounting portion 50 of the heat sink 5 via a holder 62. The projection lens 61 includes a lens made of resin or a lens made of glass. The projection lens 61 has a rear focal point (a meridional image plane that is a focal plane on an object space side) and an optical axis. The rear focal point is located at or near the other focal point of the reflecting surface. The optical axis coincides with or approximately coincides with the optical axis Z of the lamp unit 2. The projection lens 61 faces the lamp lens 11.

Here, when the lamp unit 2 makes a switch between the low beam light distribution pattern and the high beam light distribution pattern to emit the pattern, a movable shade (not shown) and a solenoid 63 (see the two-dot chain line in FIG. 1) are disposed between the reflector 60 and the projection lens 61. The movable shade is moved by the operation of the solenoid 63 to make the switch between the low beam light distribution pattern and the high beam light distribution pattern. In addition, when the lamp unit 2 emits the low beam light distribution pattern, a fixed shade (not shown) is disposed between the reflector 60 and the projection lens 61. The movable shade, the solenoid 63, and the fixed shade are attached to the holder 62, the heat sink 5, or the like, and together with the reflector 60 and the projection lens 61, constitute the light control member 6. The lower portion of the projection lens 61 of the light control member 6 and the solenoid 63 face the outlet side (the outlet 34) of the fan 3 through the heat radiating portions 51 of the heat sink 5.

(Description of Optical Axis Adjustment Mechanism 7)

The optical axis adjustment mechanism 7 includes a support mechanism 70, a first bracket 71, a second bracket 72, a swivel mechanism 73, a vertical-direction optical axis adjustment mechanism 74, a horizontal-direction optical axis adjustment mechanism 75, and a pivot mechanism 76.

The first bracket 71 is attached to the lamp housing 10 via the vertical-direction optical axis adjustment mechanism 74, the horizontal-direction optical axis adjustment mechanism 75, and the pivot mechanism 76. The second bracket 72 is attached to the first bracket 71 via the support mechanism 70. The lamp unit 2 is attached to the second bracket 72. The swivel mechanism 73 is attached to the first bracket 71. A drive shaft 77 of the swivel mechanism 73 is attached to the second bracket 72.

Rotationally manipulating an adjusting screw of the vertical-direction optical axis adjustment mechanism 74 with the use of the optical axis adjustment mechanism 7 allows the lamp unit 2 as well as the support mechanism 70, the first bracket 71, the second bracket 72, and the swivel mechanism 73 to be moved around the horizontal axis connecting the rotation center of the horizontal-direction optical axis adjustment mechanism 75 and the rotation center of the pivot mechanism 76 to move the optical axis Z in the vertical direction with respect to the lamp housing 10. In addition, rotationally manipulating an adjusting screw of the horizontal-direction optical axis adjustment mechanism 75 allows the lamp unit 2 as well as the support mechanism 70, the first bracket 71, the second bracket 72, and the swivel mechanism 73 to be moved around the vertical axis connecting the rotation center of the vertical-direction optical axis adjustment mechanism 74 and the rotation center of the pivot mechanism 76 to move the optical axis Z in the horizontal direction with respect to the lamp housing 10. These adjustments of the optical axis Z of the lamp unit 2 are made in operations performed before shipment or during maintenance.

Figure 3:
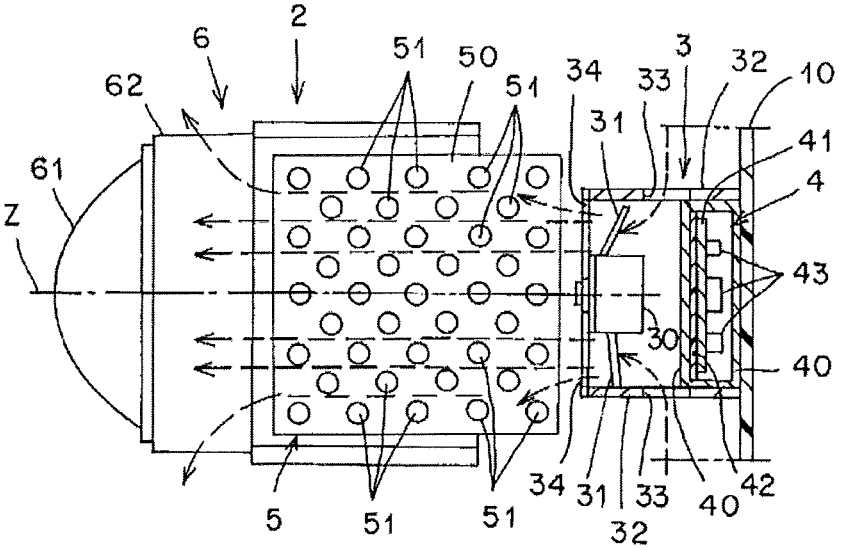
FIG. 3 is a schematic bottom view (a view taken along the arrow line III-III in FIG. 1) showing the lamp unit.
Figure 4:
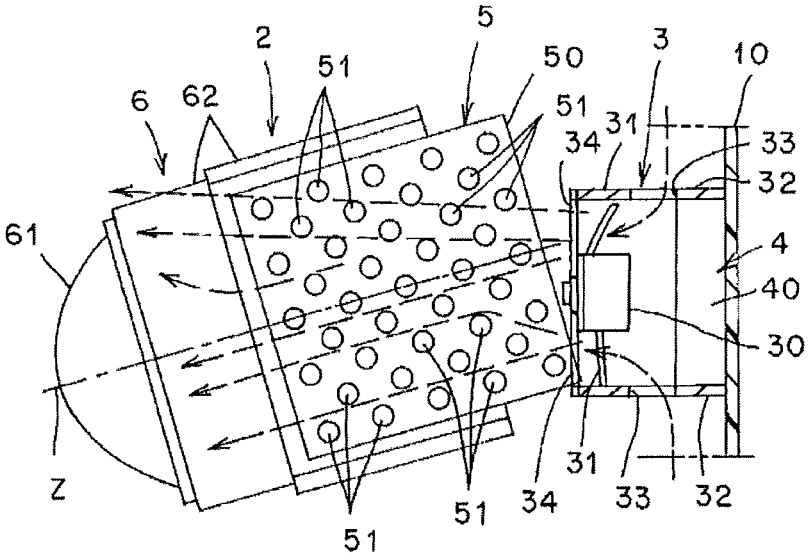
FIG. 4 is a schematic bottom view (a schematic bottom view corresponding to FIG. 3) showing a state in which the lamp unit is rotated to the right.

Meanwhile, rotating the drive shaft 77 of the swivel mechanism 73 about a vertical axis O1 passing through the rotation center of the support mechanism 70 allows the lamp unit 2 to be rotated (swiveled) in the vertical direction about the vertical axis O1 with respect to the first bracket 71 as well as the second bracket 72. The lamp unit 2 shown in FIG. 4 is in the state of being rotated in the right direction about the vertical axis O1 with respect to the lamp unit 2 shown in FIG. 3. Since FIGS. 3 and 4 are schematic bottom views, the lower sides of the drawings are the right sides at the time when the vehicular headlights 1 are mounted on the right and left sides of the front portion of the vehicle. In addition, moving the drive shaft 77 of the swivel mechanism 73 in the forward direction F or the backward direction B (see FIG. 1) allows the lamp unit 2 to be rotated in the vertical direction about a horizontal axis O2 passing through the rotation center of the support mechanism 70 with respect to the first bracket 71 as well as the second bracket 72. These orientation changes of the optical axis Z of the lamp unit 2 are automatically made by an automatic optical axis control system according to the running conditions of the vehicle.

(Description of Fan 3)

The fan 3 is attached to the back side of the lamp housing 10 (the opposite side to the lamp lens 11) separately from the lamp unit 2 as shown in FIGS. 1, 3, and 4. The fan 3 is of an axial flow type that takes in the air from the axial rear side and lets out the air to the axial front side. The axial direction of the fan 3 and the optical axis Z of the lamp unit 2 are parallel or approximately parallel to each other. The outlet side on the front side of the fan 3 faces the heat radiating portions 51 of the heat sink 5. The intake side on the rear side of the fan 3 faces the light source drive circuit 4.

The fan 3 includes a motor (not shown), an impeller 30 rotated by the motor, blades 31 provided to the impeller 30, and a casing 32 covering the motor, the impeller 30, and the blades 31. The casing 32 has a hollow cylindrical shape of which the front end and the rear end are open. The rear end of the casing 32 is attached to the lamp housing 10. A motor is attached to the front end of the casing 32 via a mounting arm.

An inlet 33 is provided to a side plate of the casing 32 at a position on the rear side of the blades 31. The range from the inlet 33 to the rear side of the blades 31 defines an inlet side of the fan 3. An outlet 34 is provided to the front end of the casing 32. The outlet 34 defines an outlet side of the fan 3.

(Description of Light Source Drive Circuit 4)

The light source drive circuit 4, together with the fan 3, is attached to the lamp housing 10 separately from the lamp unit 2 as shown in FIGS. 1, 3, and 4. The light source drive circuit 4 drives the light source 20, and adjusts the output according to the heat generation of the light source 20. The light source drive circuit 4 may have the function of controlling the driving of the fan 3.

The light source drive circuit 4 includes a casing 40, a substrate 41, and a heat conductive medium 42. The casing 40 is housed in the casing 32 of the fan 3, and is attached to the rear side of the lamp housing 10 (the opposite side to the lamp lens 11). The substrate 41 is housed in the casing 40. Electronic components 43 are mounted on one surface (rear surface) of the substrate 41. A portion of the casing 40, the portion being on the inlet side of the fan 3, (a portion on the front side) and the surface of the substrate 41 opposite to the electronic components 43 (the front surface) are tightly fixed to each other via a heat conductive medium (e.g., a heat conductive adhesive, a grease, and a heat conductive grease) 42.

(Description of the Operation of the Embodiment)

The vehicular headlight 1 according to the present embodiment is configured as described above, and the operation thereof will be described below.

The light source 20 is lit to emit light. Then, the light emitted from the light source 20 is reflected by the reflecting surface of the reflector 60 toward the projection lens 61. The reflected light is transmitted through the projection lens 61 and the lamp lens 11 to emit at least one of the low beam light distribution pattern and the high beam light distribution pattern, and irradiates an area in front of the vehicle with the light distribution pattern(s). Here, the heat generated in the light source 20 is conducted to the plurality of heat radiating portions 51 via the mounting portion 50 of the heat sink 5. In addition, the heat generated in the electronic components 43 of the light source drive circuit 4 is conducted to the portion of the casing 40 on the inlet side of the fan 3 via the substrate 41 and the heat conductive medium 42.

Meanwhile, when the motor of the fan 3 is driven, the impeller 30 and the blades 31 are rotated. Thus, the air is forced to flow. That is, the air is forcibly taken in from the inlet 33 of the casing 32 in a direction vertical or approximately vertical to the axial direction of the fan 3, and is made to forcibly flow from the inlet side to the outlet side in the axial direction of the fan 3 in the casing 32. At this time, because the air passes through the portion of the casing 40 of the light source drive circuit 4 on the inlet side portion of the fan 3, the heat generated in the electronic components 43 of the light source drive circuit 4 is efficiently cooled through the substrate 41, the heat conductive medium 42, and the casing 40.

In addition, the air forcibly made to flow in the axial direction of the fan 3 is forcibly let out from the outlet 34 of the casing 32 toward the heat radiating portions 51 of the heat sink 5. At this time, since the air passes through the space among the plurality of heat radiating portions 51 of the heat sink 5 from the side of the fan 3 toward the projection lens 61, the heat generated in the light source 20 is efficiently cooled through the mounting portion 50 and the plurality of heat radiating portions 51 of the heat sink 5.

Here, having a columnar shape, the heat radiating portions 51 of the heat sink 5 have no directivity in the direction of the air flow (the blown air direction) from the fan 3 used for heat radiation of the light source 20 as compared with heat radiating portions having a fin shape (a plate shape). Thus, when the orientation of the optical axis Z of the lamp unit 2 is adjusted and changed, for example, even when the optical axis Z of the lamp unit 2 is oriented forward as shown in FIG. 3 or even when oriented to the right as shown in FIG. 4, the air is made to forcibly flow smoothly without stagnation through the space among the plurality of columnar-shaped heat radiating portions 51.

Further, the air made to forcibly flow from the side of the fan 3 toward the projection lens 61 through the space among the plurality of heat radiating portions 51 of the heat sink 5 passes through to cool the solenoid 63, and hits the lower portion of the projection lens 61 along the incident surface of the projection lens 61 to cool the projection lens 61. The air that has cooled the solenoid 63 and the projection lens 61 is cooled while circulating in the lamp chamber 12, and forcibly let in again from the inlet 33 of the casing 32 to be let out from the outlet 34 of the casing 32 by using the fan 3.

(Description of the Effect of the Embodiment)

The vehicular headlight 1 according to the present embodiment has the above-described configuration and operation, and the effects thereof will be described below.

In the vehicular headlight 1 according to the present embodiment, the outlet side of the fan 3 faces the plurality of heat radiating portions 51 of the heat sink 5, and the inlet side of the fan 3 faces the casing 40 of the light source drive circuit 4. As a result of this, the vehicular headlight 1 according to the present embodiment can efficiently cool the light source 20 through the plurality of heat radiating portions 51 of the heat sink 5 by using the fan 3, and also can efficiently cool the light source drive circuit 4 through the casing 40 by using the fan 3.

Since the vehicular headlight 1 according to the present embodiment can efficiently cool the light source 20 through the plurality of heat radiating portions 51 of the heat sink 5 by using the fan 3, and also can efficiently cool the light source drive circuit 4 through the casing 40 by using the fan 3, the heat sink 5 and the light source drive circuit 4 can be reduced in size.

Since the vehicular headlight 1 according to the present embodiment has the fan 3 and the light source drive circuit 4 attached to the lamp housing 10 separately from the lamp unit 2, the lamp unit 2 can be reduced in size and weight. Thus, in the vehicular headlight 1 according to the present embodiment, the optical axis adjustment mechanism 7 can have optimized torque and structural strength, which allows a power portion of the optical axis adjustment mechanism 7 to be reduced in size and a structural portion of the optical axis adjustment mechanism 7 to be reduced in weight.

In the vehicular headlight 1 according to the present embodiment, the heat sink 5 includes the mounting portion 50 to which the light source 20 is attached, and the plurality of heat radiating portions 51 having a columnar shape, provided on the opposite side of the mounting portion 50 to the light source 20, and facing the outlet side of the fan 3. As a result of this, in the vehicular headlight 1 according to the present embodiment, the heat radiating portions 51 have no directivity in the direction of the air flow (the blown air direction) from the fan 3 used for heat radiation of the light source 20. Thus, in the vehicular headlight 1 according to the present embodiment, even when the orientation of the optical axis Z of the lamp unit 2 is adjusted and changed by rotating the lamp unit 2 in the vertical direction or the horizontal direction with the use of the optical axis adjustment mechanism 7 or the swivel mechanism 73, the air is made to forcibly flow smoothly without stagnation through the space among the plurality of columnar-shaped heat radiating portions 51, whereby the light source 20 can be cooled reliably and efficiently.

In the vehicular headlight 1 according to the present embodiment, concerning the vertical lengths of the heat radiating portions 51 of the heat sink 5, since the heat radiating portion 51 at the center of the mounting portion 50 at which the light source 20 is attached is longer than the other heat radiating portions 51 around the center of the mounting portion 50, the heat radiation effect of the heat radiating portion 51 at the center of the mounting portion 50 is higher than that of the other heat radiating portions 51 around the center of the mounting portion 50. As a result of this, in the vehicular headlight 1 according to the present embodiment, the light source 20 can be cooled further reliably and efficiently by the longer heat radiating portion 51 at the center of the mounting portion 50 having a higher heat radiation effect. In addition, in the vehicular headlight 1 according to the present embodiment, since the heat radiating portions 51 of the heat sink 5 are arranged in a staggered manner, the air is made to forcibly flow smoothly without stagnation through the space among the plurality of columnar-shaped heat radiating portions 51, whereby the light source 20 can be cooled further reliably and efficiently.

In the vehicular headlight 1 according to the present embodiment, the light source drive circuit 4 includes the casing 40 attached to the lamp housing 10, the substrate 41 on which the electronic components 43 are mounted, and the heat conductive medium 42 via which the portion of the casing 40 on the inlet side of the fan 3 and the substrate 41 are tightly fixed to each other. As a result of this, in the vehicular headlight 1 according to the present embodiment, the light source drive circuit 4 can be cooled reliably and efficiently.

In the vehicular headlight 1 according to the present embodiment, the lower portion of the projection lens 61 of the light control member 6 and the solenoid 63 face the outlet side (the outlet 34) of the fan 3 through the heat radiating portions 51 of the heat sink 5. As a result of this, in the vehicular headlight 1 according to the present embodiment, the projection lens 61 of the light control member 6 and the solenoid 63 can also be cooled reliably and efficiently.

(Description of Examples Other than the Embodiment)

In the above embodiment, all the heat radiating portions 51 of the heat sink 5 have a same or almost same horizontal cross-sectional area (diameter). However, it is also possible in the present invention that the heat radiating portion 51 at the center of the mounting portion 50 at which the light source 20 is attached is larger in horizontal cross-sectional area while the other heat radiating portions 51 get smaller in horizontal cross-sectional area as they get closer to the periphery of the mounting portion 50, which is not shown in the drawings. In this case, the heat radiation effect of the heat radiating portion 51 at the center of the mounting portion 50 is higher than that of the other heat radiating portions 51 around the center of the mounting portion 50, whereby the light source 20 can be cooled further reliably and efficiently. Furthermore, in addition to making the heat radiating portion 51 at the center of the mounting portion 50 larger in horizontal cross-sectional area than the other heat radiating portions 51 around the center of the mounting portion 50, making the heat radiating portion 51 at the center of the mounting portion 50 vertically longer than the other heat radiating portions 51 around the center of the mounting portion 50 allows the light source 20 to be cooled further reliably and efficiently.

While the heat radiating portions 51 are slightly larger in horizontal cross-sectional area at their upper end portions than at their lower end portions in the above embodiment, it is also possible in the present invention that the heat radiating portions 51 of the heat sink 5 are uniform or almost uniform in horizontal cross-sectional area from their upper end portions to their lower end portions, which is not shown in the drawings.

The present invention is not limited by the embodiments described above.

EXPLANATION OF SIGN

1 vehicular headlight
10 lamp housing
11 lamp lens
12 lamp chamber
2 lamp unit
20 light source
3 fan
30 impeller
31 blade
32 casing
33 inlet
34 outlet
4 light source drive circuit
40 casing
41 substrate
42 heat conductive medium
43 electronic component

5 heat sink
50 mounting portion
51 heat radiating portion
6 light control member
60 reflector
61 projection lens
62 holder
63 solenoid
7 optical axis adjustment mechanism
70 support mechanism
71 first bracket
72 second bracket
73 swivel mechanism
74 vertical-direction optical axis adjustment mechanism
75 horizontal-direction optical axis adjustment mechanism
76 pivot mechanism
77 drive shaft
B backward direction
F forward direction
O1 vertical axis
O2 horizontal axis
Z optical axis

The invention claimed is:

1. A vehicular headlight comprising:

a lamp housing and a lamp lens that form a lamp chamber;

a lamp unit disposed in the lamp chamber and attached to the lamp housing via an optical axis adjustment mechanism; and a fan and a light source drive circuit, each disposed separately from the lamp unit in the lamp chamber and attached to the lamp housing, wherein the fan and the light source drive circuit do not have any direct structural connection with structural elements of the lamp unit, and the lamp unit includes a light source driven by the light source drive circuit, a heat sink, and a light control member arranged to control light from the light source, and an outlet side of the fan faces the heat sink, and an intake side of the fan faces the light source drive circuit.

2. The vehicular headlight according to claim 1, wherein the heat sink includes a mounting portion to which the light source is attached, and a plurality of heat radiating portions having a columnar shape, provided on an opposite side of the mounting portion to the light source, and facing the outlet side of the fan.

3. The vehicular headlight according to claim 1, wherein the light source drive circuit includes a casing attached to the lamp housing, a substrate on which an electronic component is mounted, and a heat conductive medium with which a portion of the casing, the portion being on the intake side of the fan, and the substrate are closely fixed to each other.

4. The vehicular headlight according to claim 1, wherein the light control member faces the outlet side of the fan through the heat sink.

5. The vehicular headlight according to claim 1, wherein the light source drive circuit is attached, together with the fan, to the lamp housing.

6. The vehicular headlight according to claim 5, wherein a casing of the light source drive circuit is housed in a casing of the fan, the casing of the light source drive circuit and the casing of the fan being attached to a back side of the lamp housing at a position facing to the heat sink, and a front end of the casing of the fan has an outlet, and a rear end of the casing of the fan is attached to the lamp housing.

7. The vehicular headlight according to claim 5, wherein the outlet faces to the heat sink, and an inlet is provided to a side plate of the casing of the fan, the inlet facing to the casing of the light source drive circuit.

* * * * *